US005109810A

United States Patent [19]

Christenson

[11] Patent Number: 5,109,810

[45] Date of Patent: May 5, 1992

[54] TWO CYCLE INTERNAL COMBUSTION HYDROCYCLE ENGINE

[76] Inventor: Howard W. Christenson, 128 W. 73rd St., Indianapolis, Ind. 46260

[21] Appl. No.: 587,233

[22] Filed: Sep. 24, 1990

[51] Int. Cl.[5] ..... F02B 25/08

[52] U.S. Cl. ..... 123/51 R; 123/497; 417/380; 239/87

[58] Field of Search ..... 123/51 R, 51 A, 51 AA, 123/51 B, 51 BA, 51 BD, 497, 508; 417/380; 239/87

[56] References Cited

U.S. PATENT DOCUMENTS

| | | | |
|---|---|---|---|
| 2,816,416 | 12/1957 | French | 123/51 B |
| 3,274,946 | 9/1966 | Simmons . | |
| 3,604,204 | 9/1971 | Conrad et al. | 123/51 R |
| 3,918,851 | 11/1975 | Fitzgerald | 417/364 |
| 4,090,479 | 5/1978 | Kaye | 123/51 R |
| 4,306,680 | 12/1981 | Smith | 417/380 |
| 4,554,943 | 11/1985 | Claney et al. | 137/242 |
| 4,599,983 | 7/1986 | Omachi | 123/497 |
| 4,907,549 | 3/1990 | Morikawa et al. | 123/65 BA |

FOREIGN PATENT DOCUMENTS

| | | | |
|---|---|---|---|
| 3410491 | 9/1985 | Fed. Rep. of Germany | 123/51 R |
| 527395 | 4/1954 | France | 417/380 |
| 0848717 | 7/1981 | U.S.S.R. | 123/51 R |
| 2003548 | 3/1979 | United Kingdom | 123/51 R |

*Primary Examiner*—David A. Okonsky
*Attorney, Agent, or Firm*—Woodard, Emhardt, Naughton Moriarty & McNett

[57] ABSTRACT

A two-cycle internal combustion engine includes two opposed pistons reciprocatable within a cylinder, between which an air-fuel mixture is injected and ignited. One of the pistons, a compression piston, is connected to a rotatable flywheel for storing energy from reciprocation of the compression piston during the adiabatic expansion stroke. The other piston, a power piston, is attached to a pump piston which operates in a hydraulic pump to displace a hydrostatic fluid at a constant reaction pressure but at a variable stroke. Work is removed from this engine through the hydrostatic fluid, which can be fed to a hydrostatic drive unit. The flywheel is not connected to the primary load, but is used principally to drive the compression piston upward during the compression stroke of the engine. During the compression stroke, the air-fuel mixture is compressed and ignited to a pressure determined by the hydraulic reaction pressure in the hydraulic pump. The gas column is pushed upward in the cylinder, pushing the power piston upward to displace hydraulic fluid in the hydraulic pump. Ignition of the air-fuel mixture occurs during the compression stroke before the compression piston reaches top-dead-center, and can be advanced or delayed to decrease or increase the energy stored in the flywheel.

20 Claims, 5 Drawing Sheets

TWO CYCLE INTERNAL COMBUSTION HYDROCYCLE ENGINE

BACKGROUND OF THE INVENTION

The present invention concerns an internal combustion engine, and particularly an opposed piston engine. The invention also concerns an engine, designated a hydrocycle engine, for conversion of combustion energy from a column of gas between the opposed pistons to fluid displacement work.

Much recent attention has been focused upon the use of electronic controls to monitor the air-fuel mixture delivered to the engine, electronic fuel injectors to optimize the spray of fuel into the engine cylinder, and catalytic converters to reduce noxious emissions. Thus far, the focus of engine developers has been based upon standard internal combustion engine principles in which air-fuel mixture is ignited within a closed end cylinder. One recent example is represented by the two-cycle engine of the Orbital Engine Company of Perth, Australia.

It is also known that higher engine efficiency is achieved by direct conversion of combustion expansion energy into output work, as proven by gas turbine and jet aircraft engines. Internal combustion piston engines gain thermal efficiency by attaining combustion at much higher pressure and then expanding the gas over a much greater expansion ratio before exhaust. In some applications, the mechanical torque power from the crankshaft engine drives through fluid couplings or torque converters to hydrodynamically smooth clutch engagement without stalling the engine, and to provide some transmission ratio for starting heavy loads.

What is needed is an engine that combines the beneficial features of each of these engines without the limitations inherent in each. Such an engine would combine the direct conversion efficiency of a gas turbine with the high pressure expansion ratio of a piston engine, without the mechanical inertia and velocity variation of flywheel crank power. Such an engine would combine the convenient cycle control, starting, accessory drive and idle characteristics of the piston engine, with the instant direct conversion power efficiency of a turbine engine.

SUMMARY OF THE INVENTION

Although recent advancements in the engine design, particularly two-cycle engine design, have improved the performance characteristics of the engine, these advancements have been anchored to traditional engine technology. The present invention represents a welcome deviation from traditional internal combustion engine design that should generate significant improvements in fuel economy, emissions reduction, operation efficiency, power output availability, and engine life.

The present invention resides in a two-cycle internal combustion hydrocycle engine having two pistons and a gas column between them that provide an efficient means for direct conversion of combustion expansion energy to hydrostatic fluid displacement to a fluid accumulator. One piston, the reaction power piston, is uninhibited by crankshaft motion and flywheel inertia. The power piston integrates with a hydraulic pump assembly so that displacement of the power piston converts combustion expansion energy into hydrostatic fluid displacement at a controlled constant pressure.

The second lower piston, or compression piston, drives a crank and flywheel in conventional fashion and provides all the control functions of exhaust, scavenge, induction of a new charge, compression, accessory power and speed control. The compression piston handles only secondary adiabatic expansion of the combustion charge to store energy in the flywheel. This stored flywheel energy is subsequently used for compression of a new charge with surplus energy being used to lift the gas column to deliver high pressure work at the top of the compression piston stroke.

The gas charge is compressed between the power and compression pistons. Ignition and combustion of the charge accelerate the pressure rise of the charge until it reaches a hydrostatic reaction force, then the power piston displaces, in a manner similar to a rocket moving at the rate at which the fuel burns. The gas column, or fuel charge expansion, determines the function of the engine. The delivery of fluid power by the power piston is determined by the size and frequency of the gas charge between the pistons, the variable pressure of primary combustion and the total expansion ratio. The ability to salvage work through displacement of the gas column and the instant conversion of linear combustion expansion at peak pressure add to the efficiency of the engine of the present invention.

The engine of the present invention is an air-breathing engine. Air is supplied by a mechanically driven centrifugal supercharger which delivers an air charge under pressure essentially as the square of engine speed. The inlet air is unthrottled, like a Diesel engine. However, unlike conventional engines, supercharge pressure does not change the combustion pressure, but rather increases the fluid displacement work through the power piston. The maximum fuel supplied to the engine is electronically limited to near stoichiometric ratio for every cycle. The engine includes a throttle that further controls the fuel in a stratified charge, as well as ignition or fuel injection timing to match a throttle speed curve, since the crankshaft is not connected to the output load. Every combustion cycle of the hydrocycle engine delivers hydrostatic work in proportion to the fuel burned. Advancing the ignition timing slows the engine crankshaft speed, while retarding the spark delays the work load which permits the crankshaft speed to increase.

The present invention further resides in a novel rotary valve assembly used to control the intake and exhaust of gas from the engine chamber. The engine cylinder includes a number of air intake and post-combustion exhaust ports low in the cylinder wall that correspond to intake and discharge manifolds surrounding the engine. The rotary valve assembly includes a valve band encircling the engine cylinder and having inlet and outlet openings corresponding to the intake and exhaust ports in the engine cylinder. Opening and closing of the intake and exhaust ports is effected by rotating the valve band about the engine cylinder until either the solid portions or the openings of the band are aligned with the proper ports. Rotation of the valve band is controlled by an actuator that is controlled by the pressure of gas within the engine combustion chamber, just before and after the compression piston opens the exhaust ports.

In one embodiment, the rotary valve actuator is coupled to a valve control servo. This servo includes a double acting piston that controls precision timing of the valve port opening. A pressure tap in the engine cylinder above the exhaust port openings admits a pressure pulse to the servo piston, causing the piston to stroke to cinch the valve band tightly over the input ports and holding the exhaust ports open. An orifice through the servo piston allows pressure to build up on the opposite face of the piston. When the engine piston opens the cylinder exhaust ports, the pressure falls rapidly within both the cylinder and the servo inlet side. The reduced pressure on the servo inlet side allows the piston to stroke in the opposite direction, thereby causing the band to progressively close the exhaust ports and open the inlet ports for scavenging the gas from the cylinder on the downstroke of the compression piston.

As the compression piston continues to cycle, it closes the inlet ports and starts compressing the gas column. Gas pressure in the servo then again balances through the piston orifice and a spring returns the servo and band valve to the exhaust open position awaiting the next cycle. This positive port control greatly reduces scavenge losses and permits positive supercharge pressure.

The two-cycle hydrocycle engine of the present invention provides several benefits over conventional internal combustion engine designs. Placing the valve ports low in the cylinder wall permits introducing a second power piston at the top of the cylinder from which work can be easily removed. The power piston is uninhibited by flywheel inertia which permits an optimum transfer of work from the combustion expansion of the gas column within the cylinder. The combustion expansion in this hydrocycle engine matches the fuel burn rate on every cycle. In addition, the power piston moves only far enough to exchange the combustion energy, so all the work can be delivered at constant pressure without the detonation problems of proir engines.

The combustion expansion work delivered to the power piston instantly displaces hydrostatic fluid, so that the combustion energy is converted to usable work rather than in heat loss. Conversion of the combustion energy to hydrostatic work allows the hydrocycle engine to drive variable displacement motors to provide smooth starting torque and full power transmission ratio over a wide range without clutches or gear ratio shifts.

Another benefit of the hydrocycle engine of the present invention is that it conserves energy over prior internal combustion engine designs. Lower pressure adiabatic expansion drives the lower compression piston for the compression stroke, and any excess expansion energy is used to lift the gas column to displace the power piston at the top of the cylinder. The flywheel is not connected to the output load, so full power is quickly available. The hydrocycle engine also automatically operates at the minimum speed required to match the vehicle requirements, since the power piston motion is determined by the hydrostatic load.

Conventional spark ignition automotive engines deliver about ⅓ of the combustion heat energy in usable power, ⅓ to the cooling system, and ⅓ to exhaust. Combustion occurs near top dead center with very little piston motion to extract work, but has maximum temperature which loses heat to the cooling system. Nearly perfect ignition timing and high octane fuel are required to obtain good performance from conventional engines.

On the other hand, the hydrocycle engine of the present invention having a power piston pump uninhibited by crankshaft motion permits instant conversion of combustion expansion energy as soon as the compression and early combustion pressure match the reaction working pressure during the compression stroke. This extracts combustion work at lower peak temperature, with less smog and minimum time for heat loss, which facilitates complete combustion at high constant pressure during an open ended expansion stroke that tends to defeat detonation. Secondary expansion by the compression piston extracts more work before exhaust. This extended combustion cycle burns all the fuel at high pressure, extracts more useful work, and has substantially less heat loss to cooling and exhaust.

The automatic infinitely variable hydrostatic transmission driven by the hydrocycle engine gains economy by controlling the unthrottled engine to run at the minimum speed to deliver desired power. A loaded engine at low speed is much more efficient than a loafing engine at higher speed. One, two, and three cylinder engines can deliver smooth quick starts in traffic, and at least fifty miles per gallon in lighter cars. Gas cushioned fluid power provided automatic transmission torque ratio and full power any time by just opening the throttle.

Further benefits are attained by the rotary valve of the present invention, which permits positive pressure supercharge to increase the power charge with speed. A compression pressure actuated fuel injector automatically injects fuel on the compression stroke, which is more efficient than prior fuel injection schemes. Hydrocycle engine speed is controlled more efficiently than prior engines by timing the ignition to balance the flywheel/crankshaft loads.

Other aspects and benefits of the present invention will be apparent from the following written description and accompanying figures.

DESCRIPTION OF THE PREFERRED EMBODIMENTS

Figure 1:
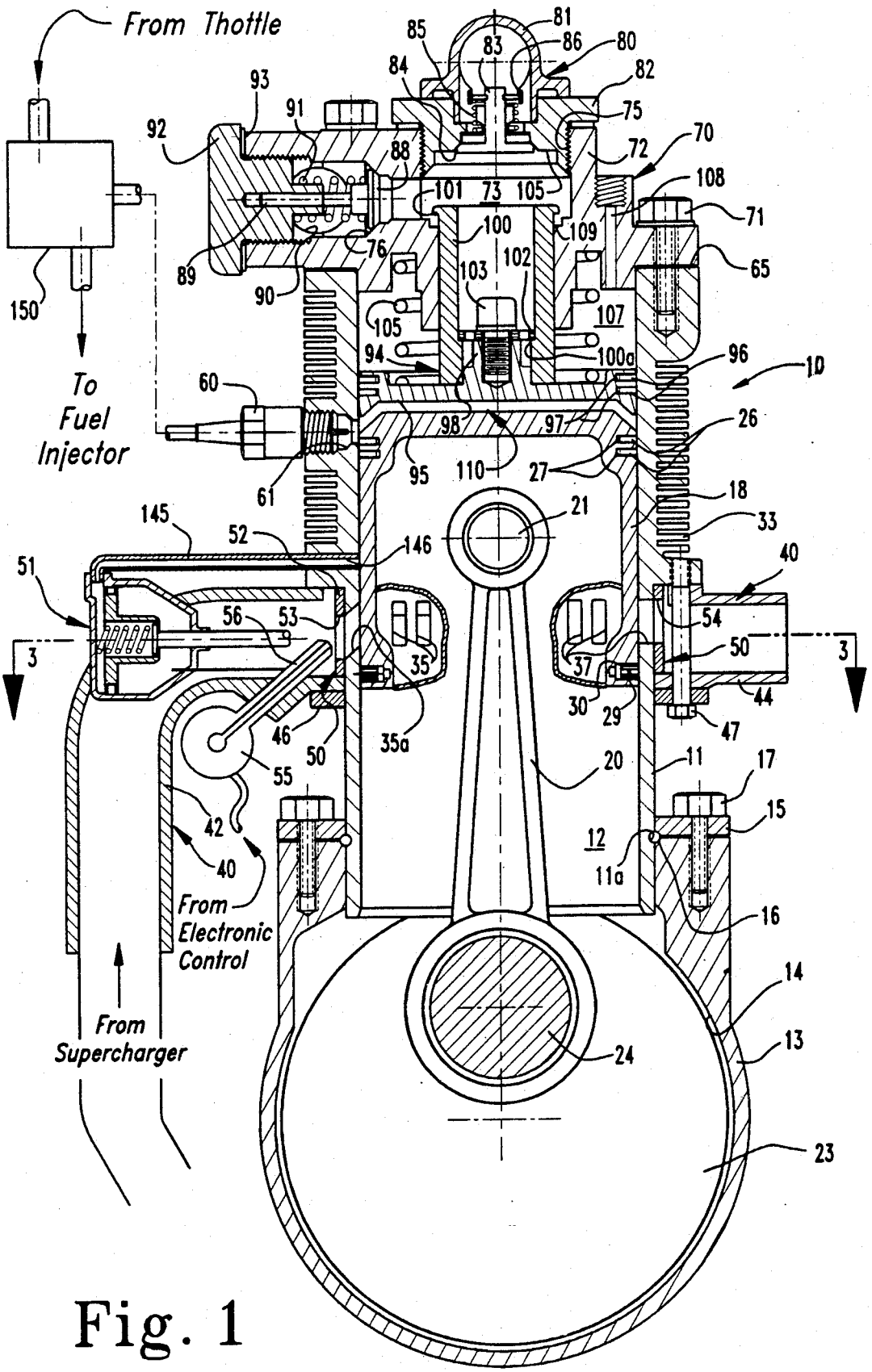
FIG. 1 is a side cross-sectional view of a two-cycle internal combustion hydrocycle engine according to a preferred embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The components of the internal combustion hydrocycle engine 10 of the preferred embodiment of present invention are shown in FIG. 1. The engine as described herein can be used to power a motor vehicle. The engine 10 includes a hollow cylinder 11 which defines a chamber 12 within. The cylinder 11 is connected to a crankcase 13. The crankcase defines a chamber 14 that is generally cylindrical in shape. The cylinder 11 is mounted to the crankcase 13 by way of a clamp ring 15 and a retaining ring 16. The retaining ring 16 is, in essence, a metal hoop having an inner diameter slightly smaller than the outer diameter of the cylinder 11. The retaining ring hoop 16 fits into a circumferential semicircular groove 11*a* around the cylinder 11. Corresponding grooves are formed in the crankcase 13 and the retaining ring 16 so that the pieces clamp the retaining ring 16. The clamp ring 15 is essentially an annular plate that is bolted to the crankcase 13 by way of bolts 17. This manner of connecting the cylinder 11 to the crankcase 13 positively clamps the individual engine cylinders to the crankcase in a multi-cylinder configuration with a strong, low stress, no lash spring steel ring that also maintains a leak-tight seal between the cylinder and crankcase.

The engine 10 includes a compression piston 18 that reciprocates within the chamber 12 of the cylinder 11. A connecting rod 20 is engaged with the piston 18 by way of wrist pin 21. The connecting rod 20 is connected at its opposite end to a flywheel 23 by way of a crankshaft 24. The piston, connecting rod and flywheel combination thus far described is configured in a manner typical in the art.

For reasons described herein, the flywheel 23 and crankshaft 24 may be free rotating to operate solely to store energy from the downstroke of the piston. In other words, unlike a typical internal combustion engine, the primary work from the engine 10 of the present invention is not taken out through the flywheel 23 or crankshaft 24. Primary power output from the engine 10 is taken out by hydrostatic oil displacement, as described more fully herein. It is understood, however, that some power may be taken out through the crankshaft 24 to perform specific functions.

The piston 18 includes a pair of ring grooves 27 within which are mounted piston rings 26. The rings 26 provide sealing at the compression/combustion face of the piston. In addition, an oil piston ring 29 is mounted within a groove 30 at the base of the piston 18 to seal the piston from oil within the crankcase 13. Both sets of piston rings seal against the inner wall of cylinder 11. The piston rings can be of conventional material and construction sufficient to provide a positive seal between the piston and cylinder wall as the piston reciprocates. The engine cylinder 11 includes a number of circumferential fins 33 for dissipating heat developed by combustion and friction.

The cylinder 11 includes a number of intake ports 35 and exhaust ports 37 to provide for the scavenge, recharge and exhaust portions of the engine cycle. A manifold 40 surrounds the intake and exhaust ports, 35 and 37, to provide a path for the intake of air into the chamber 12 and the discharge of combustion gases from the engine. The manifold 40 consists of an intake conduit 42 and an exhaust conduit 44 that are aligned with the intake ports 35 and exhaust ports 37, respectively. A manifold sealing ring 46 is bolted to the cylinder 11 by way of bolts 47 to retain the manifold 40 in sealed engagement about the cylinder wall.

Intake and exhaust through the fixed ports 35 and 37 in the cylinde 11 is controlled by a rotary valve assembly 50. The valve assembly 50 is rotatably mounted around the cylinder and is manipulated by a valve actuator 51. The rotary valve assembly 50 is comprised of a valve band 52 loosely fitted around the cylinder 11. The valve band 52 includes a number of inlet openings 53 and outlet openings 54 for alignment with the respective inlet ports 35 and exhaust ports 37 in the cylinder.

The engine 10 further includes a fuel injector 55 mounted to the manifold 40. The injector nozzle 56 of the injector 55 is oriented so that the fuel dispensed from the nozzle 56 flows directly through a cylinder inlet port 35 into the chamber 12. The injector nozzle 56 is aligned with the location of one of the inlet ports 35*a*. The inlet ports 35 are cut through the cylinder wall at an angle, as shown in FIG. 1, corresponding to the angle of the injector nozzel 56, so that the fuel and air is directed toward the top of the cylinder chamber 12 above the piston 18. The engine further includes a spark plug 60 that is engaged within the spark plug port 61. The spark plug is of conventional construction and is provided to ignite the air-fuel mixture within the cylinder chamber 12 at the appropriate time during the engine cycle.

Figure 5:
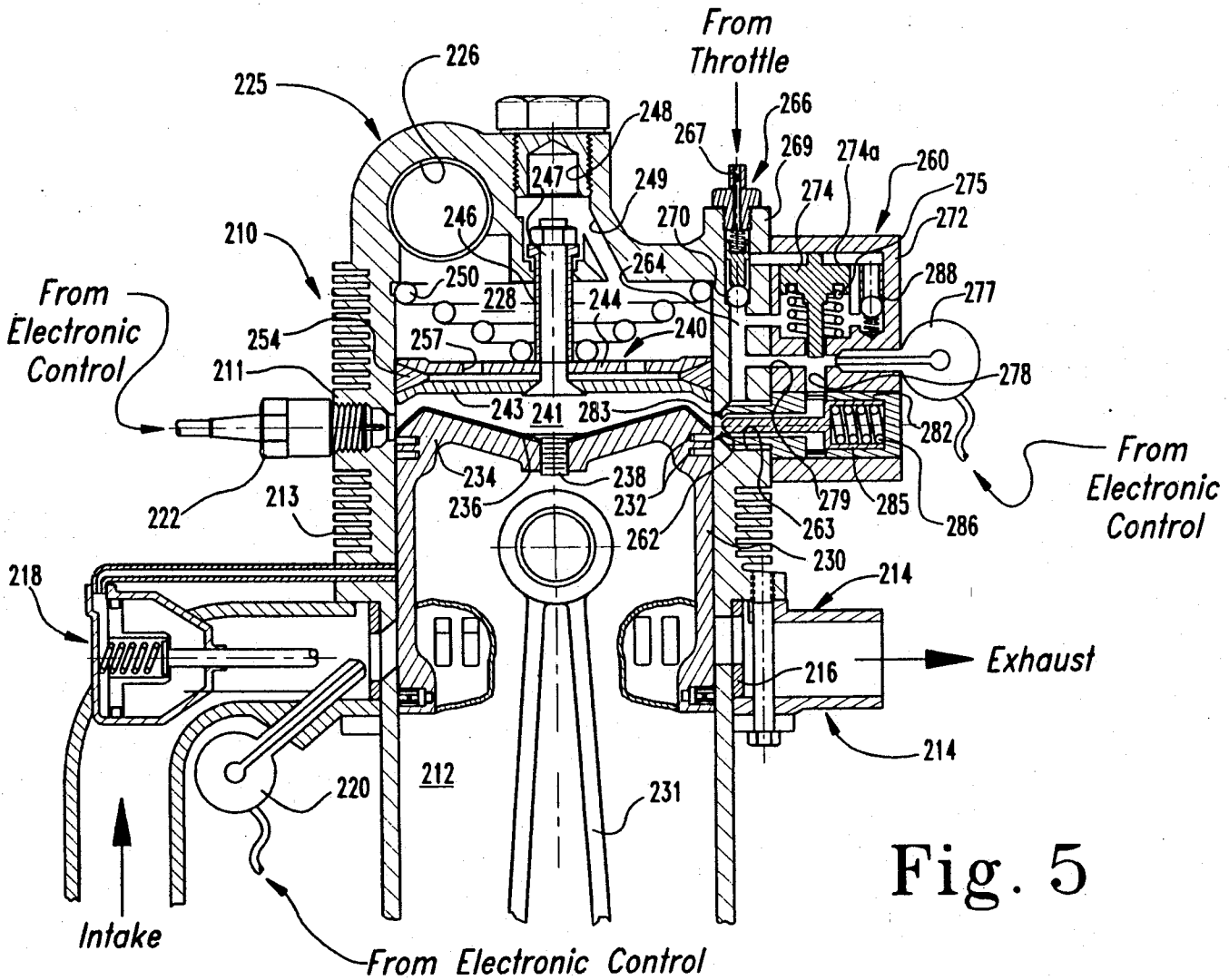
FIG. 5 is a partial cross-sectional view of another embodiment of the internal combustion hydrocycle engine of the present invention, particularly showing a pressure controlled fuel injector and a novel piston seal construction of the invention.

In an alternative embodiment shown in FIG. 5, a pressure controlled injector assembly is located diametrically opposite the spark plug 60, rather than at the manifold 40 and intake ports 37. Details of this embodiment are discussed more fully below.

Unlike standard internal combustion engines, the power is taken from the hydrocycle engine 10 through hydrostatic oil displacement by way of a hydraulic pump assembly 70 mounted over the cylinder head 65. A housing 72 of the hydraulic pump assembly 70 is connected to the cylinder head 65 by way of mounting bolts 71. Alternatively, the housing 72 can be integrally formed with the engine cylinder 11.

The housing 72 defines a hydraulic chamber 73 therein having an inlet opening 75 and an outlet opening 76. A fluid inlet valve assembly 80 is engaged at the inlet opening 75 of the housing 22. The inlet valve assembly 80 includes an inlet conduit 81 which is connected to a supply of fluid, typically hydrostatic oil. The inlet conduit 81 is mounted to a valve housing 82 which is threaded into the inlet opening 75. The valve housing 82 contains a check valve 83 that closes against a valve seat 84 in the housing to stop fluid from flowing into the inlet conduit 81 from the fluid chamber 73. A return spring 85 acts between the housing 82 and a retainer 86 affixed to the check valve 83, to bias the check valve into the closed position against the valve seat 84.

Hydraulic pump assembly 70 further includes an outlet check valve 88 that is used to discharge fluid through the outlet opening 76 in the housing 72. A discharge port opening 90 is provided in the housing 72 to communicate with opening 76. The discharge opening 90 is preferably connected to some device for utilizing pressurized hydraulic fluid. A return spring 91 is provided to bias the outlet check valve 88 against the outlet opening 76. A plug 92 is threaded into the housing 72 and provides a reaction face for the return spring 91 as well as a reciprocation bore for stem 89 of the outlet check valve 88. A gasket 93 is compressed between the plug and the housing 72 to prevent leakage.

In a further novel deviation from known two-cycle engines, a power piston assembly 94 is provided for integrating the internal combustion aspect of the engine with the operation of the hydraulic pump assembly. The power piston assembly 94 operates as the primary combustion expansion work piston in the operation of engine 10. The power piston assembly 94 is disposed at the head end of the cylinder 11 above the compression piston 18 and includes a power piston 95 that carries a number of piston rings 96 in grooves 97. The piston rings 98 act to seal portions of the cylinder chamber 12 above and below the power piston 95.

Power piston 95 further includes a boss 98 extending upward from the back face of the piston. A hydraulic pumping member or pump piston 100 is engaged about the boss 98 by a retainer washer 102 attached by a bolt 103 to the power piston 95 to hold the pump piston 100 in position. The retainer washer 102 acts against the flange 100*a* of the pump piston 100. The body of the pump piston 100 reciprocates within a piston bore 104 passing through the housing 72.

The pump piston 100 includes a stop ring 101 at the head of the piston 100 that is sized to move into a recess 109 in housing 72. Hydraulic fluid between the stop ring 101 and the recess 109 acts as a dashpot as the power piston assembly 94 moves downward after the expansion stroke. Likewise, the stop ring 101 mates with a corresponding piston head recess 105 formed in the valve housing 82 of the fluid inlet valve assembly. A dashpot effect is also achieved between the stop ring 101 and the head recess 105 at the end of the power upstroke of the power piston assembly.

The space between the housing 72 and the power piston 95 defines a bounce cavity 107. A spring 106 is disposed within the cavity 107 between the housing 72 and the power piston 95 to return the power piston assembly 94 after the expansion power stroke. A bounce pressure relief port 108 is formed in the housing 72 in communication with the bounce cavity 107. The pressure relief port 108 limits the bounce gas pressure within the cavity 107. During operation of the engine, some pressurized combustion gas leaks past the piston rings 96 to charge the bounce cavity 107. As the power piston 95 travels upward it compresses not only the spring 106 but also the gas trapped within cavity 107. After the expansion power upstroke, the spring and the compressible gas act to push the power piston assembly 94 downward.

Figures 2A, 2B, 2C, 2D, 2E, 2F:
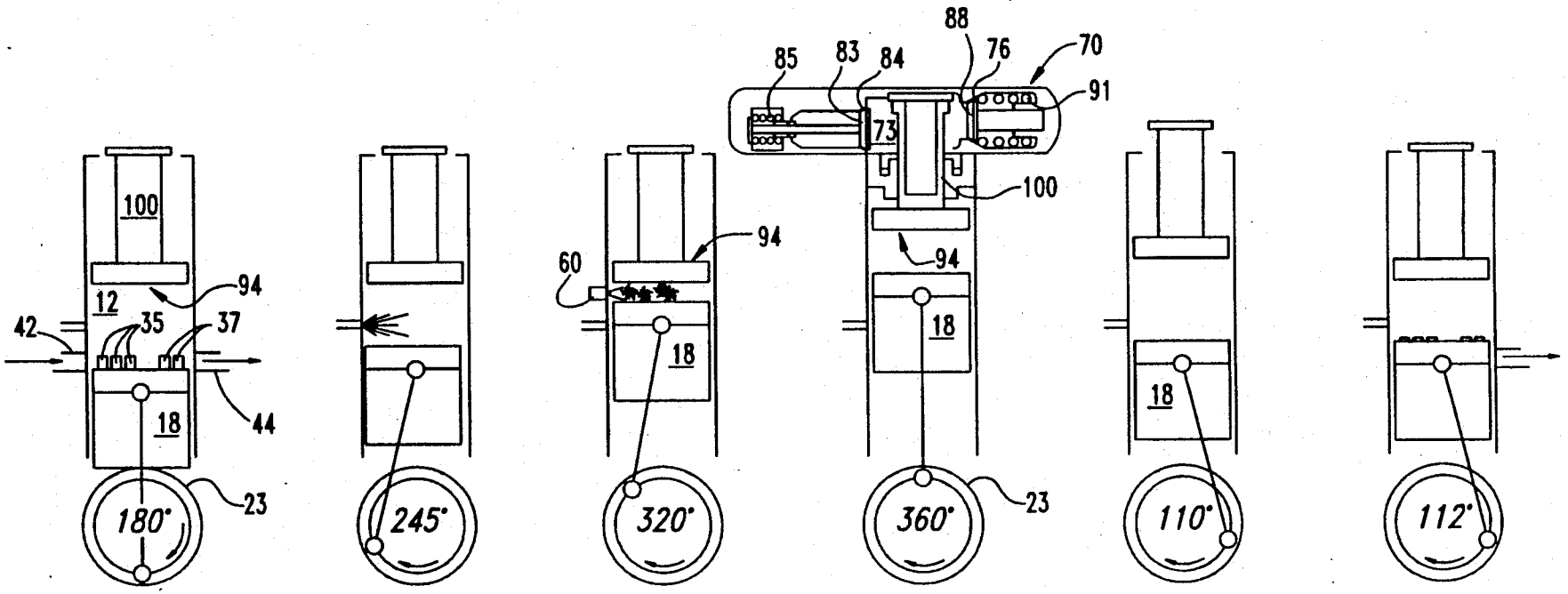
FIG. 2 is a diagrammatic illustration of the operation of the hydrocycle engine shown in FIG. 1.

The space between the compression piston 18 and the power piston assembly 94 defines a combustion chamber 110. It is in the combustion chamber 110 that the air-fuel mixture is compressed and then ignited by the spark plug 60. The general operation of the internal combustion engine 10 of the present invention is illustrated schematically in FIG. 2. In the initial Stage A of the cycle, the compression piston 18 is at bottom dead center. At this stage, the inlet ports 35 are all opened to permit the intake of air through the air intake conduit 42. Prior to the bottom dead center position in Stage A, the outlet ports 37 are also opened so that input of intake air through the inlet ports 35 tends to purge the combustion product gases from the cylinder chamber 12 as the exhaust pressure drops. The exhaust ports 37 remains open during this scavange process until the chamber pressure falls below a pre-determined value prior to bottom dead center, at which point the intake ports 35 open and the exhaust ports 37 progressively close a new charge of air can be fed to the chamber 12.

As the flywheel 23 begins to carry the piston 18 upward, fuel is injected into the chamber 12 by the fuel injector 55. The timing of the injection of the fuel is preferably electronically controlled based upon the crankshaft position. The fuel injection is timed to occur after the scavenge process is complete and after the exhaust ports have been closed. Since the injector nozzle 56 is aimed to direct fuel in intake port 37, fuel injection must also be timed to occur before the compression piston 18 covers the intake port 37. In the specific embodiment employing the pressure-controlled fuel injector of FIG. 5, the fuel can be injected at 245° of crankshaft rotation, as at Stage B, after the intak ports 37 have been covered by the piston 18.

As the compression piston 18 continues to be driven upwardly by flywheel inertia, the air-fuel mixture is compressed between the compression piston 18 and the power piston assembly 94. This compression continues until Stage C in the cycle at which the air-fuel mixture is ignited by the spark plug 60. The ignition point in the specific illustrated embodiment is at 320° of crankshaft rotation. However, the spark plug ignition is also electronically controlled and timed so that the ignition can occur earlier or later in the engine cycle, to reduce or increase the engine speed.

The pressure of the air-fuel mixture at the beginning of combustion (Stage C) is controlled by hydraulic load reaction pressure of the hydraulic pump assembly. That is, the set pressure in the hydraulic chamber 73 of the hydraulic pump assembly 70 acts against the power piston 95 in assembly 94, which assembly 94 is also acted upon by the pressure of the compressed air-fuel mixture in combustion chamber 110. As the pressure in the combustion chamber 110 increases to this reaction pressure, the power piston assembly 94 displaces upward.

The stored energy of the flywheel 23 is used to push the compression piston 18 upward during the compression stroke. Combustion occurs during this compression stroke. The residual inertia in the flywheel continues to push the gas column in the combustion chamber 110 upward, which also pushes the power piston assembly 94 upward. The action of the power piston assembly 94 displaces hydraulic fluid when the hydrostatic reaction pressure is reached. In this manner, all the useful work of engine 10 is delivered to the hydraulic fluid in the hydraulic pump assembly 70. The hydrostatic reaction pressure is determined by the outlet valve 88 opening pressure and hydraulic pressure in the hydraulic unit to which the hydrocycle engine is engaged.

As the air-fuel mixture burns, the compression piston 18 continues its upward stroke due to the rotary inertia of the flywheel 23. The combustion pressure tends to apply a negative force to the compression piston to keep the flywheel speed in control.

When pressure of the gas column during combustion reaches the reaction pressure, the power piston assembly 94 strokes upward and the pump piston 100 displaces the fluid contained in fluid chambers 73, which passes through the outlet opening 76 for use outside the engine 10. In the preferred embodiment, the fluid within the hydraulic pump assembly is a generally non-compressible fluid, such as oil, so that the engine work is directly extracted through displacement of the fluid.

In one specific embodiment, the area of the power piston 95 is about 5.8 times greater than the area of the pump piston 100. Thus, pressure exerted by the pump piston 100 on the hydraulic fluid in fluid chamber 73 is about 5.8 times greater than the pressure acting on the power piston 95. This relative area relationship allows the engine 10 of the present invention to deliver all the combustion expansion work to the hydrostatic oil displacement at pressures and volumes appropriate for hydrostatic work at Otto cycle combustion gas pressures.

As the crankshaft passes top-dead-center, the compression piston 18 is forced downward by combustion gas pressure, thereby adding rotary inertia energy to the flywheel 23. In addition, the bounce spring 106 and the elastic force of the fluid trapped within the bounce cavity 107 operate on the power piston assembly 94 to provide a secondary expansion force to the compression piston during Stage E of the cycle. In Stage F of the cycle, the power piston assembly 94 is returned to its full downward stroke position. As the compression piston 18 moves downward during adiabatic expansion, it uncovers a servo pressure port 32*a* (FIG. 1) in the cylinder wall. This port 32*a* communicates with the rotary valve assembly 50 which operates to close the input ports 35 and to open the exhaust ports 37. With the top of the compression piston 18 just past the tops of the exhaust ports 37, the combusted exhaust gas is discharged through the exhaust conduit 44 of the manifold 40. As the exhaust ports are opened, the pressure within the cylinder falls rapidly and the rotary valve assembly 50 operates, in a manner described herein, to open the inlet ports to begin the scavenge and recharge portion of the cycle (Stage A).

The novel combination of the compression piston 18 and the power piston assembly 94 of the present invention provides significant advantages over prior two-cycle engines. For example, with the engine 10 of this invention, combustion of the air-fuel mixture can be easily maintained at an optimum combustion pressure by controlling the hydraulic fluid pressure behind the power piston assembly 94, and particularly pump piston 100. Another advantage is that work is removed from the engine during the compression stroke. Combustion occurs during the compression stroke, before top dead center, and the combustion expansion, as well as the remaining upstroke of the compression piston 18, pushes the power piston assembly 94 upward.

Combustion during the compression stroke also means that the air-fuel mixture has more time to burn before exhaust and scavenge. More complete burning improves fuel economy and reduces pollution. Most of the combustion energy is converted to useful work by the power piston assembly 94 prior to the adiabatic expansion stroke. This feature reduces the amount of heat rejection to the cylinder wall sufficient to allow air cooling of the engine through the fins 33.

The agility of the power piston assembly 94 also controls detonation or "knock". The power piston assembly is lighter than the compression piston 18 and flywheel 23, and responds rapidly to combustion expansion of the air-fuel mixture at constant pressure. The hydraulic fluid in fluid chamber 73 behind the power piston assembly 94 also adds hydraulic damping after ignition.

Figure 3:
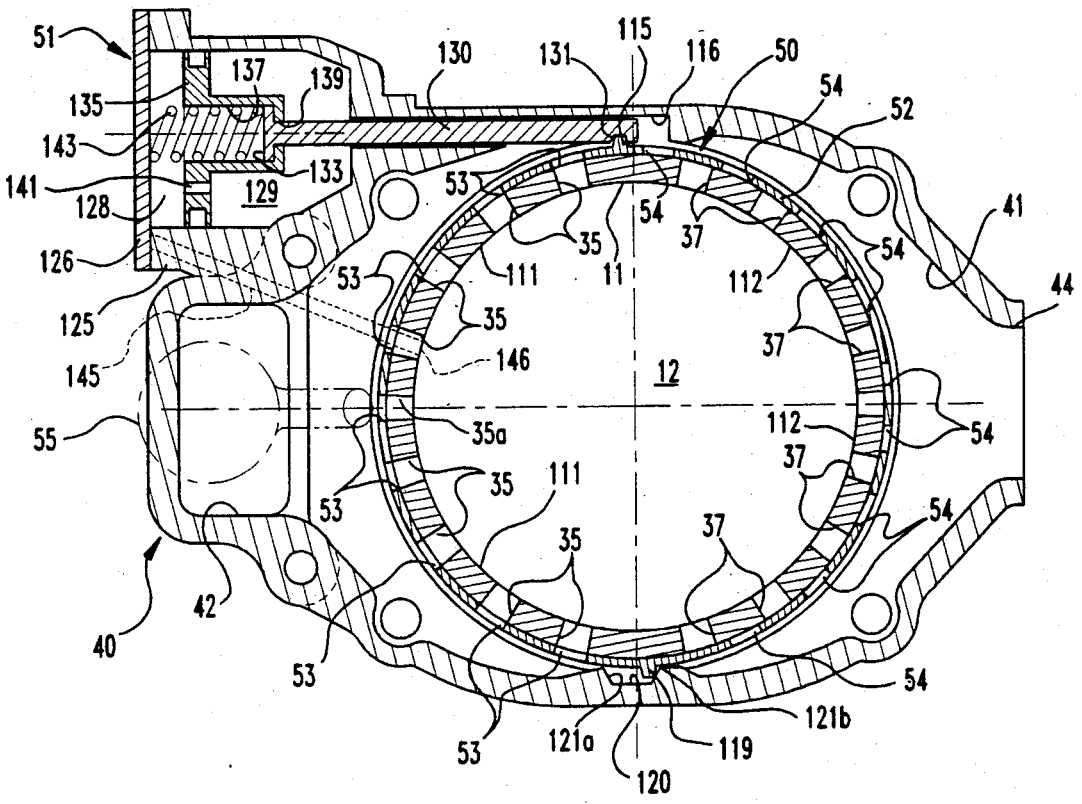
FIG. 3 is a top cross-sectional view of the hydrocycle engine shown in FIG. 1 taken along line 3–3 in FIG. 1 as viewed in the direction of the arrows, to show the rotary valve of one embodiment of the present invention.

Air intake, discharge and scavenge in the engine cylinder 11 is controlled by the rotary valve assembly 50, which is shown in detail in FIG. 3. The primary components of the rotary valve assembly 50 are the valve actuator 51 and the valve band 52. As previously described, the valve band 52 includes a number of spaced inlet openings 53 and outlet openings 54. These openings 53 and 54 respectively, are arranged adjacent corresponding intake and exhaust ports 35 and 37, respectively, in the cylinder 11. The cylinder 11 includes a number of lands 111 between the intake ports 35, and lands 112 between the exhaust ports 37.

In the air intake position, shown in FIG. 3, the inlet openings 53 of the valve band 52 are aligned with the intake ports 35 of the cylinder, while the outlet openings 54 are aligned with the exhaust side lands 112. In this configuration, the air is permitted to enter the cylinder 11 through the inlet openings 53 and intake ports 35. On the other hand, the exhaust ports 37 are closed by the solid portions of the valve band 52 so that the intake air is not discharged through the exhaust conduit 44. In one specific embodiment, the port area for the intake and exhaust ports is two square inches to permit rapid air flow at high engine speeds.

The valve band 52 includes a pair of diametrically opposite lugs 115 and 119. The first lug or actuator lug 115 connects the valve band to the actuator rod 130. The opposite lug or the anchor lug 119 moves within an anchor notch 120 in the body of the manifold 40. The anchor lug 119 and anchor notch 120 combine to restrict the amount of rotation of the valve band 52 around the cylinder. The anchor notch 120 includes a pair of opposite stop surfaces 121*a* and 121*b*. The anchor lug 119 and stop surfaces 121*a* and 121*b* are correspondingly sloped so that as the anchor lug 119 contacts one of the sloped stop surfaces the lug has a tendency to slide up the stop surface. This action between the lug 119 and stop surfaces 121*a* and 121*b* provides a force to the valve band 52 to cinch the band tightly against the cylinder wall.

At the opposite side of the valve band, the actuator lug 115 fits into a lug notch 131 in the actuator rod 130. The actuator rod reciprocates within an actuator channel 116 in the manifold 40. The actuator rod terminates at its opposite end in a head 133 which fits within a piston 135, which reciprocates within a servo body 125. A removable cover 126 encloses the piston so that the piston 135 forms a pair of cavities 128 and 129 within the servo body 125. A cylinder pressure cavity 128 is at the pressure side of the piston 135 and is fed by gas pressure from the engine chamber 12 along a servo pressure line 145. The servo pressure line, as shown in FIGS. 1 and 3 extends from the servo body 125 to the cylinder 11, opening at the servo pressure orifice 146 into the chamber 12.

The piston 135 includes a spring bore 137, and a concentric rod bore 139 through which the actuator rod 130 extends. A valve spring 143 is disposed within the spring bore 137 between the head 133 of the actuator rod 130 and the cover 126 to return the servo piston 135, and hence the valve band 52, to the exhaust open position for the next engine cycle. In this position, the anchor lug 119 contacts the left stop surface 121*a*. The piston 135 also includes a bleed orifice 141 which provides fluid communication between the cylinder pressure cavity 128 on the pressure side of the piston and the other cavity, the bleed pressure cavity 129, on the actuator rod side of the piston.

In operation, as the engine piston 18 nears the end of its expansion stroke, the top of the piston uncovers the servo pressure orifice 146 in the cylinder wall 11. High pressure gas from the cylinder chamber 12 passes through the servo pressure line 145 into the cylinder pressure cavity 128. The high pressure in the cylinder pressure cavity 128 acts on the piston 135 and the actuator rod head 133 to stroke the actuator rod 130 so that the valve band 52 is rotated clockwise around the cylinder 11. The actuator rod moves the valve band until the anchor lug 119 is forced up the sloped left stop surface 121*a*. The valve band 52 is then pulled tightly or cinched against the cylinder with the solid portions of the valve band 52 covering the intake ports 35 in the cylinder 11.

At the same time, the outlet openings 54 of the valve band 52 align with the exhaust ports 37 in the cylinder 11 to permit high pressure blow-down from the chamber 12. Thus, the combination of the actuator rod 130 and the anchor lug 119 provides for positive sealing of the valve band 52 over the intake ports 35 prior to the scavenge process. This same sealing effect occurs at the opposite end of the actuator rod stroke when the anchor lug 119 is pulled up the right stop surface 121*b* and the valve band 52 is cinched tightly over the exhaust ports.

When the servo piston 135 and actuator rod 130 are fully stroked to the inlet closed position (that is to the rightmost position as depicted in FIG. 3), high pressure gas in the cylider pressure cavity 128 leaks through the bleed orifice 141 into the bleed pressure cavity 129. The gas continues to leak through orifice 141 until the pressures in the pressure and bleed pressure cavities are equilibrated.

As the compression piston 18 continues its downward stroke, the combustion gases in the chamber 12 continue to exhaust through the exhaust conduit 44. The pressure within the chamber 12 drops rapidly, as well as the pressure in the servo pressure line 145 and the cylinder pressure cavity 128 of the rotary valve actuator 51. As the pressure in the engine chamber 12 and cylinder pressure cavity 128 drops, the high pressure in the bleed pressure cavity 129 forces the servo piston 135 back toward the servo body cover 126. As the piston returns, the actuator rod 130 strokes to rotate the valve band 52 in a counterclockwise direction around the engine cylinder.

During this transition, the anchor lug 119 is between the left and right stop surfaces 121*a* and 121*b* of the anchor notch 120, so that the valve band 52 is loosely fitted around the cylinder 11. Also in this configuration, a portion of the inlet openings 53 of the valve band 52 communicate with the intake ports 35 of the engine cylinder 11, and the outlet openings 54 also partially communicate with the exhaust ports 37. This orientation of the valve band 52 permits the scavenge process of the engine cycle as supercharged air passes through the intake conduit 42, inlet openings 53 and inlet ports 35 into the chamber 12 to scavenge the combustion product. During transition, that is while the band is moving between the fully opened or fully closed position, the loose fit of the valve band 52 provides for smooth non-sticking actuation of the valve.

When the engine chamber pressure, and consequently the pressure in the cylinder pressure cavity 128, has decreased sufficiently, the higher pressure in the bleed pressure cavity 124 forces the piston and actuator rod to their left-most position, shown in FIG. 3, in which the intake ports 35 are open and the exhaust ports 37 are closed. The supercharge pressure then builds up in the cylinder and new fuel is injected into the chamber 12 for the next compression cycle. When the compression piston 18 reciprocates upward, it closes the servo pressure orifice 146. The pressures in the servo cavities 128 and 129 equalizes so that the only force acting on the piston 135 is from the return spring 143. The spring force of spring 143 is enough to stroke the valve band 52 to the exhaust open position awaiting the next exhaust cycle.

The rotary valve assembly 50 provides means for positively sealing the intake and exhaust ports of the engine cylinder at appropriate points in the engine cycle. The actuation of the valve band 52 is based primarily upon the engine combustion pressure. The action of the rotary valve assembly 50 is controlled by the rate at which the engine chamber exhaust pressure decreases when the compression piston 18 open the exhaust ports during the down stroke of the piston. The faster the engine runs, the faster the higher gas pressure operates the rotary valve assembly 50.

In the preferred embodiment, the valve band 52 is loosely fitted about the cylinder wall 11. In one specific embodiment, the valve band 52 has a diametral clearance of between 0.030 and 0.040 inches about the cylinder. The inlet and outlet openings are spaced at 18° intervals around the cylinder 11 and the valve band 52, but the openings each have less than a 9° span. The valve band 52 is oriented so that the band need only rotate through a 9° arc to either fully open or fully close the intake and exhaust ports of the cylinder 11. In one specific embodiment, the valve band is formed of stainless steel to provide long-life actuation capability.

In another aspect of the invention, an electronic control 150 (FIG. 1) is provided to control the injection of the fuel through fuel injector 55 and the timing of the ignition spark from spark plug 60. The electronic control receives a signal from the throttle or accelerator that is controlled by the vehicle operator. The electronic control also receives a signal from an engine sensor (not shown) indicative of crankshaft rotation and engine charge pressure. The control 150 then provides signals to the fuel injector 55 and the spark plug 60 to activate these components at appropriate points in the engine cycle.

In a novel feature of the present invention, the speed, and ultimately output power, of the engine 10, is controlled by changing the timing of the firing of the spark plug 60 to ignite the air-fuel mixture within the engine chamber 12. By advancing the timing of the spark, that is by causing the spark plug 60 to fire before the compression piston 18 reaches top-dead-center, a negative force is applied to the head of the compression piston 18, thereby slowing the piston down. On the other hand, retarding the ignition timing causes the engine speed to increase as the compression piston is permitted to move closer to top-dead-center before the retarding force is applied.

When the ignition timing is retarded, the rotary inertial of the flywheel 23 that causes the piston to reciprocate upward on the up stroke, is not counteracted or depleted by the pressure of early ignition of the air-fuel mixture. On the other hand, when the ignition timing is advanced, the combustion pressure acts against the rising compression piston to slow the piston and the flywheel.

Advancing or retarding the spark or ignition also controls the amount of useful work taken out through the hydraulic pump assembly, and the amount of work available through the flywheel and crankshaft. Advancing ignition timing causes combustion to occure earlier in the engine cycle, well before the compression piston 18 reaches top-dead-center of its stroke. When combustion occurs, the power piston assembly 94 performs its function of displacing the hydraulic fluid as it is driven upward by the burning of the mixture. At the same time, the compression piston 18 continues to move farther upward toward top-dead-center, thereby pushing the gas column upward while combustion is occurring. Pushing the gas column in the combustion chamber 110 operates directly on the power piston assembly 94 to increase its rate and amount of upward movement. In this manner, the useful work delivered by the hydraulic pump assembly 70 through hydrostratic fluid displacement is increased.

On the other hand, retarding the spark until the compression piston 18 is closer to top-dead-center means that the gas column in the chamber 12 has less negative torque leverage so the flywheel speed is less affected. This greater available crankshaft work can be used as a secondary power output for the engine 10 in certain applications of the engine. To the extent that this additional work in the flywheel is not used as secondary power or to compress the air-fuel mixture, it is added to the gas column during the next combustion phase of the cycle to increase the hydrostatic fluid displacement of the hydraulic pump assembly 70.

Figure 4:
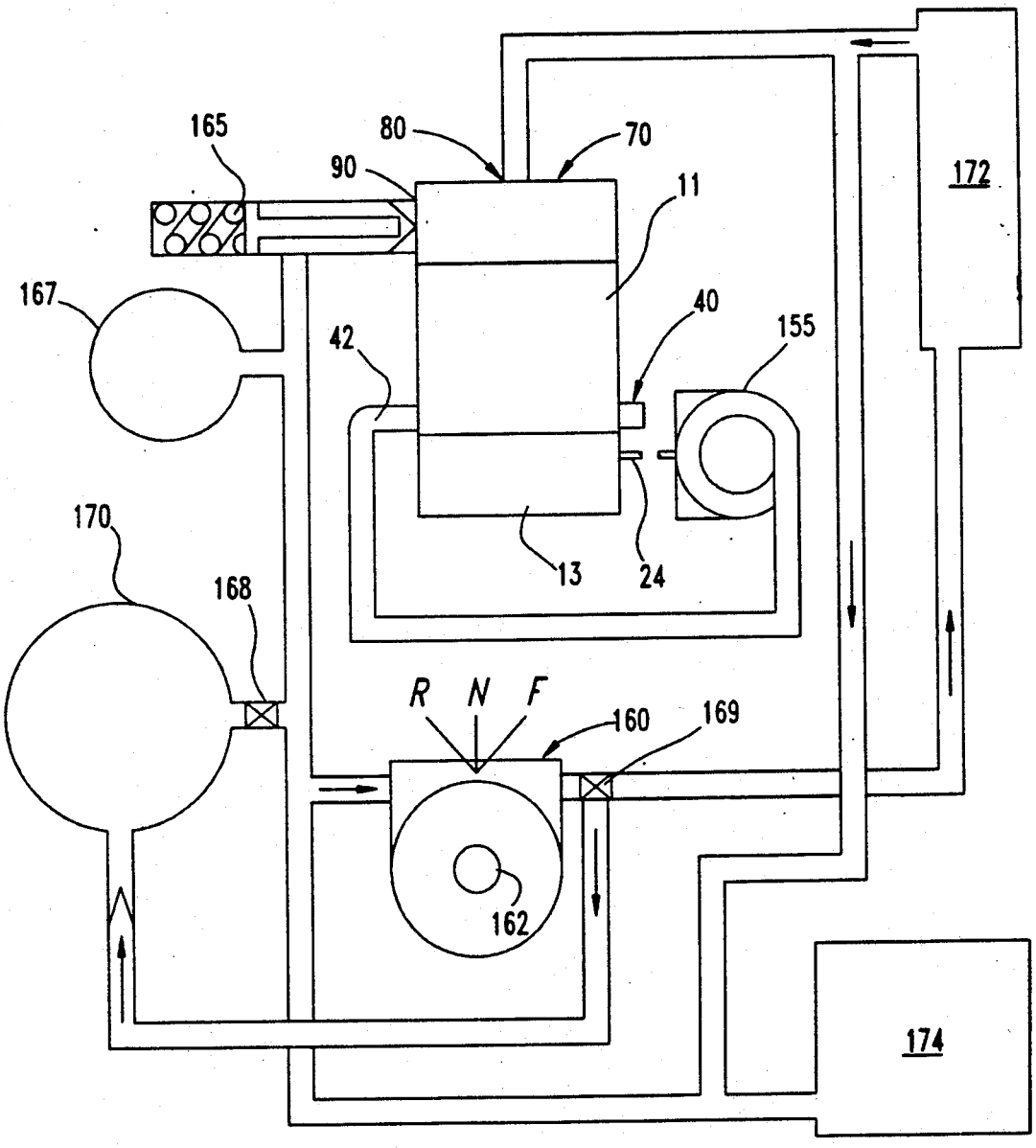
FIG. 4 is a schematic illustration of one application of the hydrocycle engine of the present invention for use with a hydrostatic drive system.

In one embodiment of the invention, the crankshaft 24 is mechanically connected to a supercharger device 155, as shown in FIG. 4. The supercharger can be of conventional centrifugal construction, and capable of supercharge pressures up to 15 p.s.i. Since the crankshaft 24 is not geared to the output load, it is free to drive the supercharger 155 to provide increased charging pressure as the engine speed increases. The supercharger provides a high pressure charge of air through the intake conduit 42 of the manifold 40. This supercharged air does not increase the combustion pressure, since the power piston assembly 94 automatically moves once the combustion pressure is reached. However, the use of supercharged air does increase the fluid displacement of the hydraulic pump assembly 70 since the combustion chamber is more fully charged and combustion expansion pressure causes the power piston assembly to move farther.

The electronic control can include a sensor for determining the supercharge pressure, which pressure will increase with increased speed. The electronic control 150 can then match the fuel injected from the electronic fuel injector 55 to the charge of air provided by the supercharger 155.

FIG. 4 illustrates schematically one application of the engine 10 of the present invention. In this application, the pressurized fluid output from the engine 10 is fed to a hydrostatic transmission or drive system 160. The hydrostatic drive system 160 includes an output shaft 162 which can be used to directly drive a vehicle wheel. In the preferred embodiment, fluid discharged through discharge opening 90 in the hydraulic pump assembly 70 passes through a one-way valve 164 that is monitored by a spring valve 165. An accumulator 167 dampens minor fluctuations in fluid pressure prior to the hydrostatic drive system. The speed of the hydrostatic drive system is maintained by a closed system including valve 168, retarder valve 169 and large accumulator 170, which operate based upon fluid pressure to and from the drive system 160. In the preferred embodiment, the drive system 160 is a variable displacement motor.

Fluid is provided to the fluid inlet valve assembly 80 of the hydraulic pump assembly 70 through a cooler 172. Fluid from the hydrostatic drive system 160 passes through the retarder valve 169 to the cooler 172. A sump 174 is provided to maintain the hydraulic fluid supply through the large accumulator 170.

An additional embodiment of the two cycle internal combustion hydrocycle engine of the present invention shown in FIG. 5. The engine 210 includes a cylinder body 211 that defines a chamber 212 within. The cylinder body 211 also includes external cooling fins 213. The engine 210 also includes a manifold 214, rotary valve assembly 216, and valve actuator 218 which are similar in construction and operation to the corresponding components 40, 50 and 51 of the embodiment shown in FIG. 1. A first fuel injector 220 and a spark plug 222 are also included, which are also substantially similar to their counterparts in the previous embodiment.

In a variation from the first embodiment, the engine cylinder body 211 also forms the housing for pump assembly 225. The pump assembly 225, which replaces the assembly 70 of the embodiment of FIG. 1, includes an inlet-outlet conduit 226. The conduit 226 includes inlet and outlet check valves (not shown) that are similar in operation and construction to the check valves 83 and 88 of the previous embodiment. The cylinder body 211 defines a fluid chamber 228 which forms a part of the pump assembly 225.

The engine 210 includes a novel piston 230, in substitution for piston 18 of the previous embodiment. Like the prior piston, the piston 230 is attached to a connecting rod 231 that is attached to a flywheel (not shown) in a manner similar to that shown in FIG. 1. At the piston head 234 of the piston 230 are a pair of piston rings 232, similar to the piston rings 26 of the previous embodiment. The piston 230 includes a heat shield 236 which is affixed to the piston head 234 by way of a screw 238. One object of the heat shield is to reduce heat transfer to the piston, which keeps the heat of combustion in the gas column to do more useful work. The heat shield also regenerates waste heat to the new charge, which leads to a reduction in ignition delay time. In the preferred embodiment, the head shield is composed of stainless steel. However, another similar material may be used to protect the piston 230 from the high temperatures of combustion.

The engine 210 also includes a power piston assembly 240 that is different in construction from the piston assembly 94 of the previous embodiment. As with the previous embodiment, the piston 230 and power piston assembly 240 define a combustion chamber 241 therebetween which is generally aligned with the spark plug 222. The power piston assembly 240 includes a lower plate 243, an upper plate 244 and a dashpot stem 246 which are connected by way of a bolt 247. The dashpot stem 246 is arranged to reciprocate within a dashpot recess 248 then the pump assembly 225 to provide viscous damping at both ends of the power piston stroke. A vent bore 249 is provided between the dashpot recess 248 and the fluid chamber 228 so that fluid displaced by the dashpot stem 246 is returned to the fluid chamber. A conical bounce spring 250 is situated between the cylinder body 211 and the upper plate 244 to operate in a manner similar to the bounce spring 106 of the previous embodiment.

As is apparent from a comparison of the embodiments of FIGS. 1 and 5, the power piston assembly 240 is essentially a single diameter unit resulting in nearly identical gas and oil pressures on either side of the piston assembly 240. In other words, the area of the portion of the piston assembly displacing fluid from the fluid chamber 228—that is, the area of the upper plate 244—is identical to the area of the combustion face of the piston assembly—that is the area of the lower plate 243. This particular arragnement is well suited for high pressure diesel applications in which the pressure multiplication effect of the piston assembly 94 of the previous embodiment is not required.

With the single diameter power assembly 240 of the present embodiment, the same pressure exists on either side of the upper and lower plates, 243 and 244, respectively. Consequently, conventional ring seals may not properly seal because these seals generally seat against only one face. In order to provide adequate sealing between the combustion chamber 241 and the fluid chamber 228, a novel plastic seal 254 is included in engine 210. The seal 254 has a generally triangular cross section as shown in FIG. 5. The seal is adapted to be pinched between the lower plate 243 and upper plate 244 so that the seal 254 radially expands into contact with the cylinder wall 211. The seal of one specific embodiment is composed of a carbon tetrafluoroethylene, such as Teflon®. The seal material must be capable of adequate Poisson expansion when compressed between the upper and lower plates, yet provide a sufficient bearing surface for sliding contact with the cylinder wall. The seal 254 can also be reinforced with carbon fiber throughout the seal circumference.

The seal is mechanically spring loaded by the piston plates to contact the cylinder wall. It is bubble tight and the seal material is very gentle with the cylinder surface. Since the seal 254 has the same pressure load on all sides, it is oblivious to the cyclic pressure and has minimum friction drag. The seal is well cooled and lubricated by the oil being pummped.

In another specific embodiment, the upper plate 244 is provided with a number of holes 257 therethrough so that oil can pass into the gap between the two plates 243 and 244 and provide cooling to the seal 254. In addition, the provision of the holes 257 prevents the seal 254 from being cyclically squeezed between the upper and lower plates by the full piston loads.

The engine 210 shown in FIG. 5, also includes a pressure activated fuel injector assembly 260. This injector assembly 260 is intended to operate in conjunction with the first fuel injector 220 located at the lower end of the engine cylinder 211. Alternatively, the pressure actuated fuel injector assembly 260 can replace the lower fuel injector 220.

The fuel injector assembly 260 includes an injection port 262 formed in the cylinder wall 211 in communication with the combustion chamber 241. The injection port 262 can be located lower in the cylinder wall than shown in FIG. 5 to permit the seal rings 232 in the piston 230 to seal off the injection port during high pressure combustion. The injection port 262 opens into a pintle bore 263 and a pressure passageway 264. The pressure passageway communicates with a throttle valve 266. The throttle valve 266 is fed from a pressure actuated throttle (not shown) by way of a throttle pressure tube 267. The throttle can be of known design in which variations in throttle position produce variations in the pressure of a fluid within pressure tube 267. The throttle pressure operates on a trigger piston 269 which controls the operation of a ball check valve 270. In one specific embodiment, the throttle valve 266 is designed to open at about 100 psi pressure within the engine chamber 212, as communicated through the pressure passageway 264. When the throttle valve 266 is open (that is when the ball check valve 270 is lifted from its seat), gas travels into the assembly body 272 to act on the pressure face **274*a* of an injector piston 274. The pressure acting on the injector piston 274 causes the piston to stroke against a return spring 275**.

A second fuel injector 277 is mounted within assembly body 272. The fuel injector 277 is arranged so that fuel is injected into a fuel passageway 278 within the body 272. The injector piston 274 strokes within the fuel passageway 278 to push the fuel in the pintle valve 282. The pintle valve 282 is of standard construction and includes an injector nozzle 283 directly aligned with the injection port 262. The pintle valve 282 also includes a needle valve 285 which is spring biased by spring 286. The pintle valve is closed by spring 286. The spring cavity is also filled with fuel and very little entrained air. To open, the spring and fluid must be compressed. The fluid compresses about 3% per thousand, so the needle opening is small, insuring a fine air-fuel spray and a quick close. The high rate fluid spring is self-adjusting and very reliable. When the injector piston 274 strokes within the fuel passageway 278, the rising pressure of the fuel within the passageway causes the needle valve 285 to lift from the injector nozzle 283, thereby allowing fuel to pass directly to a combustion chamber 241. When the pressure within the combustion chamber 241 drops sufficiently low, the throttle valve closes so that the ball check valve 270 seats. At this point, the return spring 275 operates to push the injector piston 274 back to its original position. A pressure relief valve 288 is provided to relieve any gas trapped behind the injector piston 274 on its return stroke. Reduction in pressure in the pintle valve 282 allows the spring 286 to stroke the needle valve 285 to close the pintle bore 283.

A gas passageway 279 is provided between the pressure passageway 264 and the fuel passageway 278. When fuel is initially injected by the injector 277 to the fuel passageway 278, gas under pressure is admitted through the gas passageway 279 to mix with the newly injected fuel, to create a fine mist of fuel and air. Thus, the operation of the fuel injector assembly 260 allows the injection of a high pressure mist of fuel and air into the combustion chamber 241.

The fuel injector 277 can be electronically controlled, just as the fuel injector 220 previously described. Fuel is then electronically limited to near stoichiometric ratio. In addition, electronic control can be used to selectively operate either the lower fuel injector 220, or the upper fuel injector 277, depending upon the fuel injection requirements for a given engine operating condition. The throttle valve 266 operates to limit the quantity of fuel injected into the combustion chamber 241. The throttle valve can also retard the injector timing by increasing the pressure required to open the ball check 270. When the engine cylinder pressure drops to exhaust, all the pressures within the fuel injector assembly 260 drop to ready the assembly 260 for the next fuel charge.

While the invention has been illustrated and described in detail in the drawings and foregoing description, the same is to be considered as illustrative and not restictive in character, it being understood that only the preferred embodiments have been shown and described and that all changes and modifications that come within the spirit of the invention are desired to be protected.

What is claimed is:

1. An internal combustion engine comprising:

a hollow cylinder;

a compression piston reciprocatably disposed within said cylinder;

means, including a rotatable flywheel connected to said compression piston, for storing energy from reciprocation of said compression piston;

a power piston reciprocatably disposed within said cylinder and opposing said compression piston;

a pump having;

a housing defining a fluid chamber for containing a fluid;

a fluid inlet to said fluid chamber;

a fluid outlet opening outside the engine for discharging a fluid from the engine through said fluid chamber;

a pumping member movably disposed within said fluid chamber to displace a fluid contained therein through said fluid outlet, said pumping member being attached to said power piston;

means for injecting a combustible mixture between said compression piston and said power piston;

means for igniting said combustible mixture, whereby ignition of said combustible mixture causes said power piston to move away from said compression piston within said cylinder and said pumping member to move with said power piston to displace fluid from said fluid chamber through said fluid outlet; and means for controlling the injection and ignition of said combustible mixture for self-sustaining reciprocation of said compression piston.

2. The internal combustion engine of claim 1, wherein said means for injecting a combustible mixture includes a supercharger driven by said rotatable flywheel.

3. The internal combustion engine of claim 1, further comprising:

air intake ports and gas exhaust ports defined through said cylinder; and intake/exhaust valve means for controlling the opening and closing of said air intake ports and said gas exhaust ports in response to the pressure of said combustible mixture between said compression piston and said power piston.

4. The internal combustion engine of claim 1, wherein said means for injecting a combustible mixture includes:

a fuel inlet communicating into said cylinder; and pressure actuated fuel injector means for injecting fuel into said cylinder, said fuel injector means including;

an injector body defining a piston cavity, a fuel passageway and a feed opening communicating with said fuel passageway;

a needle valve communicating between said fuel passageway and said fuel inlet;

an injector piston reciprocatably disposed within said piston cavity;

a plunger attached to said injector piston and reciprocatably disposed within said fuel passageway to push fuel from said feed opening through said passageway to said needle valve; and a pressure opening communicating between said piston cavity and said cylinder, whereby gas under pressure passing through said opening into said piston cavity reciprocates said injector piston in response to the pressure within said cylinder.

5. The internal combustion engine of claim 3, wherein said air intake and said gas exhaust ports are arranged in said cylinder to be covered by said compression piston when said piston is at top dead center of its stroke.

6. In an internal combustion engine having a cylinder with a head end, a compression piston connected to a rotatable flywheel for reciprocating the compression piston within the cylinder through an expansion stroke and a compression stroke, means for injecting a combustible mixture into the cylinder after the expansion stroke, and means for igniting the combustible mixture at a pre-determined point in the compression stroke, the improvement comprising:

a pump housing attached at the head end of the cylinder, defining a fluid chamber for containing a fluid, and having a fluid inlet to said chamber and a fluid outlet opening outside the engine for discharging a fluid from the engine through said fluid chamber;

a power piston reciprocatably disposed within the cylinder opposing the compression piston; and a pumping member attached to said power piston and movably disposed within said fluid chamber.

whereby ignition of the combustible mixture causes said power piston to move apart from the compression piston such that said pumping member, moving with said power piston, displaces a fluid from said fluid chamber through said fluid outlet.

7. The improvement of claim 6, wherein:

said power piston includes a first circular plate;

said pumping member includes a second circular plate having substantially the same diameter as said power piston plate;

a resilient seal between said first and second plates; and means for pinching said seal between said first and second plates so that said seal expands radially into contact with the engine cylinder.

8. An internal combustion process in an engine having a combustion cylinder, a pump disposed at the head end of the combustion cylinder, the pump containing a fluid for discharge therefrom, a compression piston and an opposing power piston, both pistons reciprocatably disposed within the cylinder, a flywheel connected to the compression piston for storing energy from reciprocation of the compression piston, a pumping member attached to the power piston and being operably disposed within the pump so that movement of the pumping member displaces fluid within the pump for discharge, the process comprising the continuous cyclic steps of:

injecting an air-fuel mixture into the combustion cylinder between the compression piston and the power piston;

compressing the air-fuel mixture between the compression piston and the power piston by upward reciprocation of the compression piston;

igniting the air-fuel mixture so that combustion expansion of the mixture causes the power piston to move apart from the compression piston; and removing work from the engine through discharge of fluid from the engine through the hydraulic pump by reciprocation of the pumping member, moving with the power piston, within the fluid chamber.

9. The internal combustion process of claim 8, further including the steps of:

moving the air-fuel mixture within the cylinder by upward reciprocation of the compression piston during the compressing step after a reaction pressure is reached at which the power piston moves with the air-fuel mixture, the reaction pressure being determined by the hydraulic pressure within the pump; and removing work from the engine through discharge of fluid from the engine through the hydraulic pump by reciprocation of the pumping member moving with the power piston during the moving step.

10. The internal combustion process of claim 9, wherein: said igniting step occurs during said compressing step; and said moving step occurs after said igniting step.

11. The internal combustion process of claim 8, further comprising the steps of:

after the ignition step, moving the gas product of combustion of the air-fuel mixture within the cylinder by upward reciprocation of the compression piston, so that the power piston moves with gas product; and removing work from the engine through displacement discharge of fluid from the engine through the hydraulic pump by reciprocation of the pumping member, moving with the power piston, within the fluid chamber.

12. The internal combustion process of claim 8, further comprising the step of:

recycling a portion of the work from the combustion expansion to the compression piston substantially equal to the work required to compress the air-fuel mixture during the compressing step of a subsequent cycle.

13. An internal combustion process in an engine comprising the continuous cyclic steps of:

injecting an air-fuel mixture into an engine cylinder between a compression piston and an opposing power piston;

driving the compression piston upward in a compression stroke by removing energy stored in a rotating flywheel;

compressing the air-fuel mixture between the compression and power pistons by the upward motion of the compression piston during the compression stroke;

igniting the air-fuel mixture so that combustion expansion of the mixture drives the power piston upward away from the compression piston and so that the combustion expansion provides a downward force on the compression piston;

removing work from the engine through the upward motion of the power piston;

storing energy in the rotating flywheel, for removal during the driving step, from downward motion of the compression piston during an expansion stroke after combustion of the air-fuel mixture; and controlling the amount of energy stored in the flywheel by variably controlling the timing of the ignition step so that the downward force is applied relatively earlier or later in the compression stroke of the compression piston.

14. The internal combustion process of claim 13, wherein the expansion stroke is adiabatic.

15. The internal combustion process of claim 13, further comprising: moving the gas product of combustion of the air-fuel mixture upward within the engine cylinder by upward motion of the compression piston after the igniting step so that the power piston moves upward with the gas product.

16. The internal combustion process of claim 13, further comprising: moving the air-fuel mixture upward within the engine cylinder by upward motion of the compression piston during the compressing step, so that the power piston moves upward with the mixture.

17. The internal combustion process of claim 13. wherein said step of removing work from the power piston is accomplished by discharge of a hydraulic fluid under pressure from the engine by the pumping member.

18. The internal combustion process of claim 17, wherein said compressing step is accomplished by said driving step and includes compressing the air-fuel mixture to a reaction pressure determined by the pressure of the hydraulic fluid.

19. In an internal combustion engine having a cylinder, a compression piston connected to a rotatable flywheel for reciprocating the compression piston within the cylinder through an expansion stroke and a compression stroke, a fuel injection port through the cylinder, and means for igniting a combustible mixture within the cylinder at a pre-determined point in the compression stroke, a pressure actuated fuel injector assembly for injecting the combustible mixture through the fuel injection port into the cylinder, comprising:

an assembly body attached to the cylinder, the body defining a fuel inlet, a fuel passageway communicating with said fuel inlet, a piston cavity, and a pressure passageway communicating between said cylinder and said piston cavity;

a needle valve communicating between said fuel passageway and the fuel injection port for controlling the flow of fuel passing through the injection port;

an injector piston reciprocatably disposed within said piston cavity;

a plunger attached to said injector piston and disposed within said fuel passageway to push fuel from said fuel inlet through said passageway to said needle valve.

whereby said injector piston reciprocates in response to the pressure within the engine cylinder comunciated to said piston cavity through said pressure passageway;

a pressure actuated check valve interposed within said pressure passageway between the engine cylinder and said piston cavity; and means for controlling the pressure at which said check valve opens.

20. In an internal combustion engine having a cylinder, a compression piston connected to a rotatable flywheel for reciprocating the compression piston within the cylinder through an expansion stroke and a compression stroke, a fuel injection port through the cylinder, and means for igniting a combustible mixture within the cylinder at a predetermined point in the compression stroke, a pressure actuated fuel injector assembly for injecting the combustible mixture through the fuel injection port into the cylinder, comprising:

an assembly body attached to the cylinder, the body defining a fuel inlet, a fuel passageway communicating with said fuel inlet, a piston cavity, and a pressure passageway communicating between said cylinder and said piston cavity;

a needle valve communicating between said fuel passageway and the fuel injection port for controlling the flow of fuel passing through the injection port;

an injector piston reciprocatably disposed within said piston cavity;

a plunger attached to said injector piston and disposed within said fuel passageway to push fuel from said fuel inlet through said passageway to said needle valve, whereby said injector piston reciprocates in response to the pressure within the engine cylinder communicated to said piston cavity through said pressure passageway; and a gas passageway communicating between said pressure passageway and said fuel passageway, whereby gas from the engine cylinder is permitted to flow through said gas passageway into said fuel passageway to mix with fuel within said fuel passageway.

* * * * *